United States Patent [19]

Hagens et al.

[11] Patent Number: 4,830,303

[45] Date of Patent: May 16, 1989

[54] PROCESS AND DEVICE FOR WINDING A FILM WEB

[75] Inventors: Hajo Hagens, Wiesbaden; Reinhard Kober, Eltville; Wolfgang Oberhausen, Wiesbaden, all of Fed. Rep. of Germany

[73] Assignee: Hoechst Aktiengesellschaft, Frankfurt am Main, Fed. Rep. of Germany

[21] Appl. No.: 145,424

[22] Filed: Jan. 19, 1988

[30] Foreign Application Priority Data

Mar. 28, 1987 [DE] Fed. Rep. of Germany ..... 3710412

[51] Int. Cl.[4] ..... B65H 16/02; B65H 18/08

[52] U.S. Cl. ..... 242/67.1 R

[58] Field of Search ..... 242/67.1 R, 65, 55, 242/75.1

[56] References Cited

U.S. PATENT DOCUMENTS

| | | | |
|---|---|---|---|
| 3,602,448 | 8/1971 | Muensterer | 242/67.1 R |
| 3,670,980 | 6/1972 | Mukai | 242/67.1 R |
| 3,749,328 | 7/1973 | Dusenbery | 242/67.1 R |
| 4,343,440 | 9/1982 | Engl | 242/67.1 R |
| 4,491,283 | 6/1985 | Pav et al. | 242/67.1 R |
| 4,546,930 | 10/1985 | Rohde et al. | 242/65 |
| 4,576,344 | 3/1986 | Sasaki et al. | 242/67.1 R |

*Primary Examiner*—Stuart S. Levy
*Assistant Examiner*—John M. Eghtessad
*Attorney, Agent, or Firm*—Gregory N. Clements

[57] ABSTRACT

In a gusset-shaped space 6 between a film roll 8 and a contact roller 3, two air displacement rollers *5a,5b*, are arranged parallel to the axes of the film roll and the contact roller. These rollers have in contrast to the contact roller and the winding core 2, and the film roll, respectively, small diameters of 7.5 to 50 mm. These rollers displace the air layers 4 adjacent to the film web 1 which are moving into the gusset. The selected distance for the displacement of the air layers between the point of contact of the film roll and the contact roller is so small, that new air layers on the film webs within the gusset can only be formed in the smallest amounts.

17 Claims, 1 Drawing Sheet

PROCESS AND DEVICE FOR WINDING A FILM WEB

BACKGROUND OF THE INVENTION

The present invention relates to an improved process for contact winding a film web onto a winding core to obtain a film roll. More particularly, the present invention relates to a contact winding process in which air layers adjacent the film surface are substantially displaced from the film web immediately prior to winding. The present invention also relates to an apparatus for the wrinkle-free winding of a film web.

The last step in the manufacturing process of films is the winding of the film web into a film roll. This winding step is highly significant. If a film web which is within specification is "incorrectly" wound, damage to the film can result in a possible total loss of the film roll, especially through storage.

An especially important problem within this context is the phenomenon of air entrapment. Enormous amounts of air are entrapped in the winding core during the winding of the film web. A portion of the entrapped air escapes from the winding core during its storage, thereby possibly causing various flaws, such as collapses, gauge bands, and TD lines. These flaws can lead to the complete uselessness of the film roll.

U.S. Pat. No. 4,576,344 discloses a device for winding polyester film webs, in which the film web being conveyed onto the winder is pressed against the winder with the aid of a contact roll, thereby reducing the amount of air entrapped during winding. The air-displacing effect of the contact roll lessens with increasing winding speed, however, so that a compromise must be made between increasing the winding speed and minimizing the entrapment of air. The whole phenomenology of entrapped air under special consideration of the dependence of entrapped air on the contact roll pressure against the winder is the object of research and development.

It has also been suggested to perform the entire winding procedure in a vaccuum in order to solve the problem of air entrapment. The huge financial expenditure required for vacuum winding, however, speaks against the realization of this suggestion.

The object of the invention is to improve the process described at the outset, and to further develop an apparatus for winding a film web in such a way, that the entrapped air is considerably reduced with little technical expenditure.

BRIEF SUMMARY OF THE INVENTION

In one aspect, the present invention is a process for winding a film web without substantial entrapment of air comprising:

(i) transporting a film web partially around a rotating contact roll;

(ii) transferring said film web to the outer surface of a film roll carried on a rotating winding core;

such that immediately prior to said transfer both the outer film surface of said film roll and the outer surface of said film web are independently treated to substantially displace the air layers which are otherwise carried by said outer film surfaces.

In another aspect, the present invention is an improved apparatus for winding a film web comprising:

(i) a rotably-mounted winding core;

(ii) a rotably-mounted contact roller in cooperating parallel axial relationship with said winding core and operatively connected to means for rotation of said contact roller, such that (1) rotation of said contact roller about its axis will impart rotation to said winding core about its axis but in a direction of rotation opposite that of said contact roller, and (2) a film web can be transported partially around said contact roller and thereafter transferred to said winding core;

(iii) a pair of rotably-mounted air displacement rollers in cooperating parallel axial relationship with said winding core, such that one of said rollers is in pressure contact relationship with the outer surface of the film web wound upon said winding core and the outer roller is in pressure contact relationship with the outer surface of the film web being transported partially around said contact roller, such that a gusset-shaped space is defined by said rollers, said winding core, and said contact roller.

DETAILED DESCRIPTION OF THE INVENTION

As summarized above, the present invention relates to a process in which air layers adjacent to the film web on the circumferential surface of the film web being conveyed through the contact zone are displaced from the film surfaces before the two film webs are brought together.

In the practice of the process, the air layers adjacent to the film webs are displaced over the entire widths of the film webs by means of mechanical pressure. Appropriately, the distance from the point of contact or point of joining, respectively, of the two film webs, to the air displacement points on the film webs ranges from 13 to 200 mm.

The apparatus for wrinkle-free winding of a film web onto a winding core comprises a contact roller having a circumferential surface over which the film web is conveyed to the winding core, whereby the contact roller and the film roll wound on the winding core rotate at the same circumferential speeds, but in opposite directions. The apparatus may be further characterized by having two air displacement rollers arranged parallel to the axes of the winding core and of the contact roller, in a gusset-shaped space which is bounded by the contact roller on the one side and by the winding core or the film roll, respectively, on the other side. These air displacement rollers are in pressure contact with the film web on the film roll and with the film web on the contact roller.

The present invention substantially reduces the amount of air entrapped within a film roll during winding of the film web. This reduction is accomplished with little capital expenditure. More specifically, only two additional rollers, both having small diameters, must be added to the contact winder. The rollers are arranged parallel to the axis of the film roll and contact roller, and displace air layers adhering to the film webs which are moving into the gusset-shaped space between the contact roller and the film roll. During this process, the shortest distance between the air displacment rollers and the contact point of the film roll and contact roller is selected so that only small air layers can form on the surface of the film web.

The invention will now be further illustrated by reference to the drawings.

Figure 1:
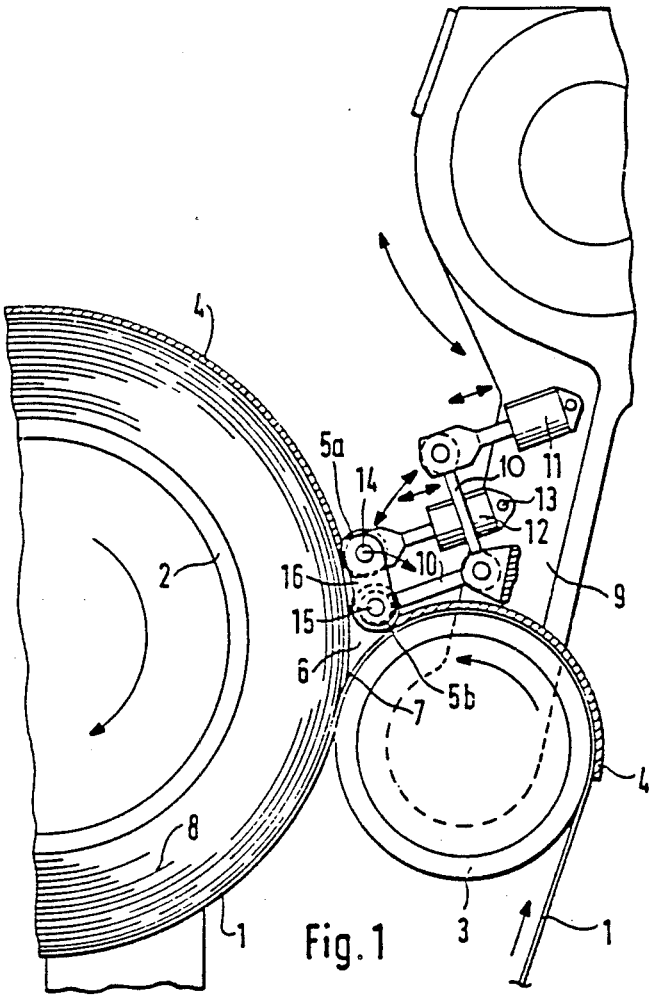
FIG. 1 is a side view of a cross-section of an apparatus according to the invention.

Referring now to FIG. 1, a film web 1 is transported over a contact zone in the form of a contact roller 3, which rests against a film roll 8, to be wound onto a winding core 2. The film roll and the contact zone move in opposite directions at the same speed. Both the film web 1 transported over the contact zone and the outer area of the film web 1 on the film roll 8 carry air layers which are displaced before the two film webs are brought together. The air layers adjacent to the film webs are displaced over the entire width, of the film webs by means of mechanical pressure. The distance from the point of contact or point of joining, respectively of the two film webs to the air displacement points on the film webs, that is, the depth of the gusset shaped space, which is bounded by the film roll and the contact zone, is maintained as small as possible, and is 13–200 mm.

In the device according to FIG. 1, a film web 1 is conveyed over the contact roller 3, runs at a point of contact onto a winding core 2 and film roll 8, respectively, and is wound onto these. During this winding process, considerable amounts of air accumulate between the film roll 8 and the contact roller, which can be explained through the fact that air layers adjacent to the film web 4, hatched in FIG. 1, adhere to the film webs 1, are subject to friction, and are transported with them towards the point of contact 7. These air layers 4 exist both outside the film web 1, which is conveyed over the contact roller 3, and on the circumferential surface and the outer area of the film web 1 on the film roll 8, respectively.

With the help of two air displacement rollers 5*a* and 5*b* which are arranged parallel to the axis of the film roll 8 and of the contact roller 3, the air layers 4, before entering the gusset-shaped space 6, are displaced or strongly reduced, respectively, from the film webs. Air displacement rollers 5*a* and 5*b* have a diameter of 7.5 to 50 mm and extend over the whole film web width. The distance between the point of contact 7 and air displacement rollers 5*a* and 5*b* should be as small as possible in order to avoid, or to keep as small as possible, the new formation of air layers in the gusset-shaped space 6. Therefore, the diameters of air displacement rollers 5*a* and 5*b* are chosen small, in comparison to the diameter of contact roller 3 and winding core 2 or film roll 8. The diameters of air displacement rollers 5*a* and 5*b* generally are of equal size, although their size may vary. The diameters of the air displacement rollers correspond from 0.1 to 0.5 times, preferably from 0.15 to 0.3 times, the diameter of the contact roller and 0.05 to 0.3 times, preferably 0.1 to 0.2 times the diameter of the winding core. Air displacement rollers 5*a* and 5*b* can only then effectively eliminate the air layers 4 if they are pressed with strong pressure against film web 1 which is conveyed over contact roller 3. Apparatus components 9–16 are designed for this purpose and are described below.

In reference to the contact roller holder 9, air displacement roller 5*b*, resting against the contact roller 3, is stationarily mounted during the winding process, whereby each of the ends is pressed via an articulated lever 10 through a cylinder 11 against the contact roller 3. Both cylinders 11 are fastened to the contact roller holder 9.

Because the winding diameter changes during the winding process, air displacement roller 5*a*, resting against the film roll 8, must be movably mounted. Provided for this are a cylinder 12 pivoted in a hinge 13, as well as a spacing member 16 pivoted in hinges 14 and 15, which together convey air displacement roller 5*a* and which with growing winding diameters, make their displacement vis-a-vis the stationarily mounted roller 5*b* possible.

Figure 2:
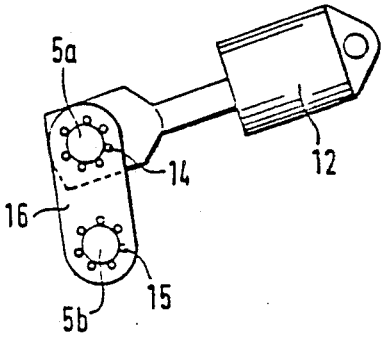
FIG. 2 is a detail, in side view, of the apparatus illustrated in FIG. 1.

The spacing member 16, as well as both hinges 14 and 15, for example, have ball bearing hinges, are enlarged together with the cylinder 12 in FIG. 2.

To be sure, the contact roller 3 and the film roll 8 and also air displacement rollers 5*a* and 5*b* have one and the same circumferential speed, but for safety reasons, a small distance of from 0.4 to 1.5 mm, preferably from 0.5 to 1 mm, should always be planned between the rollers 5*a* and 5*b*, so that in case they touch at small differences in speed, blocking or stuttering between the rollers 5*a* and 5*b* can be avoided.

Figure 3:
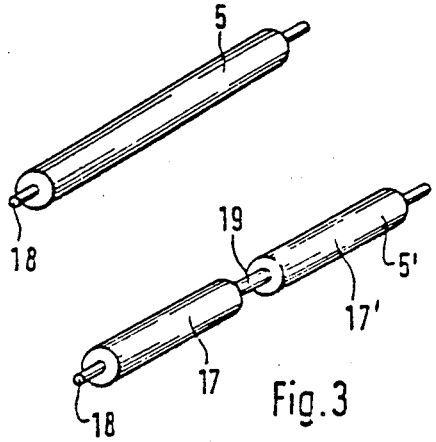
FIG. 3 illustrates two models for rollers for air displacement adjacent to the film webs.

The widths of the film webs 1 amount to up to 100 mm, but wider film webs can also be wound with such a device. If with the wider film webs the mechanical stability of displacement rollers 5*a* and 5*b* does not suffice when they are only mounted at the roller ends, then instead of one part rollers 5, as is shown in FIG. 3, which, over the entire length, possess a uniform contour and constant diameter, respectively, and, which are mounted on an axis 18, rollers 5' (see FIG. 3) consisting of two or more segments 17,17' can be used. These segments process an uniform diameter and are also mounted on an axis 18. The mechanical load of the multi-segment roller can be reduced by the mounting of further cylinders 11 and 12 on the roller distance segments 19.

The roller distance segments 19 have a diameter smaller than the roller diameter of the segment 17,17' and form a recesed roller space between the two neigboring segments of the multi-segmented roller 5'.

I claim:

1. An improved apparatus for winding a film web comprising:

(i) a rotably-mounted winding core;

(ii) a rotably-mounted contact roller in cooperating parallel axial relationship with said winding core and operatively connected to means for rotation of said contact roller, such that (1) rotating of said contact roller about its axis will impart rotation to said winding core about its axis but in a direction of rotation opposite that of said contact roller, and (2) a film web can be transported partially around said contact roller and thereafter transferred to said winding core;

(iii) a pair of rotably-mounted air displacement rollers in cooperating parallel axial relationship with said winding core, such that one of said rollers is in pressure contact relationship with the outer surface of the film web wound upon said winding core and the other roller is in pressure contact relationship with the outer surface of the film web being transported partially around said contact roller, such that a gusset-shaped space is defined by said rollers, said winding core, and said contact roller.

2. The apparatus of claim 1 wherein said air displacement rollers each have an outside diameter in the range of from 7.5 to 50 mm, and a length which is at least equal to the width of said film web.

3. The apparatus of claim 2 wherein said air displacement rollers have the same outside diameter, said diameter being from 0.1 to 0.5 times the diameter of said contact roller.

4. The apparatus of claim 3 wherein the outside diameter of said air displacement rollers is in the range of from 0.15 to 0.3 times the outside diameter of said contact roller.

5. The apparatus of claim 2 wherein said air displacement rollers have different outside diameters.

6. The apparatus of claim 2 wherein said air displacement rollers have the same outside diameter, said diameter being from 0.05 to 0.30 times the diameter of said winding core.

7. The apparatus of claim 6 wherein the outside diameter of said air displacement rollers is in the range of from 0.1 to 0.2 times the diameter of said winding core.

8. The apparatus of claim 4 wherein the distance from each of said air displacement rollers to the point, where a film web is transferred from said contact roller to said winding core, is in the range of from 1 to 6 times the outside diameter of the respective air displacement roller.

9. The apparatus of claim 1 wherein each of said air displacement rollers comprises a single cylindrical member which extends over the entire width of the film web.

10. The apparatus of claim 1 wherein at least one of said air displacement rollers comprises two or more cylindrical members, each having the same outside diameter and carried upon a shaft, but separated from one another by a cylindrical roller spacing member having a smaller outside diameter than the outside diameter of said cylindrical members.

11. The apparatus of claim 1 wherein said air displacement rollers are each rotably mounted to the mounting for said contact roller.

12. The apparatus of claim 11 wherein the roller which is in pressure contact relationship to the film web wound upon said winding core is movably and rotably mounted and is guided by means of a cylinder, said cylinder being pivotably mounted upon said mounting for said contact roller.

13. The apparatus of claim 12 wherein said air displacement rollers are connected with one another and maintained at a fixed distance from one another by means of a spacing member pivotably mounted to the ends of said rollers.

14. The apparatus of claim 11 wherein the air displacement roller which is in pressure contact relationship to said contact roller is mounted in fixed, rotable relationship to said contact roller.

15. The apparatus of claim 14 wherein each end of said air displacement roller which is in pressure contact relationship with said contact roller is connected via an articulated lever to a cylinder, and the two cylinders are fastened to said mounting for said contact roller.

16. The apparatus of claim 11 wherein the distance between the circumferential surfaces of said air displacement rollers is in the range of from 0.4 to 1.5 mm.

17. The apparatus of claim 16 wherein the distance between the circumferential surfaces of said air displacement rollers is in the range of from 0.5 to 1.0 mm.

* * * * *